United States Patent [19]

Weaver

[11] 4,104,062

[45] Aug. 1, 1978

[54] PROCESS FOR MAKING ALUMINUM MODIFIED BORON CARBIDE AND PRODUCTS RESULTING THEREFROM

[75] Inventor: Gerald Q. Weaver, Princeton, Mass.

[73] Assignee: Norton Company, Worcester, Mass.

[21] Appl. No.: 849,927

[22] Filed: Aug. 13, 1969

[51] Int. Cl.[2] ..... B22F 3/00

[52] U.S. Cl. ..... 75/238; 75/203; 75/204; 75/226; 75/249; 89/36 A; 109/84

[58] Field of Search ..... 75/204, 203, 226, 236, 75/238, 249; 29/182.7, 182.8; 89/36 A; 109/84

[56] References Cited

U.S. PATENT DOCUMENTS

| | | | |
|---|---|---|---|
| 2,746,133 | 5/1956 | Lowe | 29/182.8 |
| 3,178,807 | 4/1965 | Bergmann | 29/182.8 |
| 3,364,152 | 1/1968 | Lipp | 75/204 |
| 3,431,818 | 3/1969 | King | 89/36 A |
| 3,749,571 | 7/1973 | Stibbs et al. | 75/238 |

*Primary Examiner*—Brooks H. Hunt
*Attorney, Agent, or Firm*—Arthur A. Loiselle, Jr.

[57] ABSTRACT

A process for fabricating high density aluminum modified boron carbide compositions comprising the steps of blending specific quantities of powdered boron carbide and powdered aluminum together with a small quantity of temporary organic binder, preforming this mixture to the desired shape with high pressure at room temperature, followed by final densification of the finished product at a temperature below the sintering temperature of boron carbide and at a pressure as low as 500 psi. The resulting compositions are near theoretical density and possess a degree and type of strength which make them well suited as protective armor against penetration by ballistic projectiles.

8 Claims, No Drawings

PROCESS FOR MAKING ALUMINUM MODIFIED BORON CARBIDE AND PRODUCTS RESULTING THEREFROM

BACKGROUND OF THE INVENTION

The invention relates to a process for forming high density boron carbide compositions. More particularly, the invention relates to a process of forming high density boron carbide reacted with specified amounts of aluminum, and the products resulting from said process.

Methods of forming useful articles from boron carbide are well known in the art. The most widely used method, particularly when the resultant product is to have a high density, is that of hot-pressing. Because of the nature of boron carbide, hot-pressing to a high density requires temperatures in the neighborhood of 2300° C and pressures of at least 1500 lbs. per sq. inch and preferably a pressure of 2500 lbs. per sq. inch, in an oxygen free atmosphere, usually after first preforming the shape by cold-pressing the boron carbide powder. Boron carbide fabricated in such a manner has been made into such artifacts as jet nozzles, turbine blades, sand blasting nozzles, wire drawing dies, mold liners, and the like and even more recently, armor plate for protecting personnel and equipment from ballistic projectiles. To fabricate high quality artifacts such as those mentioned above, the boron carbide powder is generally relatively pure, which inherently then, is relatively expensive.

More recent developments in the art, as disclosed in the Lowe U.S. Pat. No. 2,746,133, have brought forth improved boron carbide compositions. Higher strength jet nozzles, turbine blades, and the like have resulted from using boron carbide compositions reacted with 2 to 5% aluminum; such products exhibit higher strengths than the previously known boron carbide parts. Artifacts made from the boron carbide-aluminum composite system are more economical than the older essentially pure boron carbide products because the boron carbide-aluminum system does not require that the boron carbide be of as high purity as is required when boron carbide containing no additives is used. The process required, however, for fabrication of boron carbide-aluminum artifacts, is somewhat more complex than that used for straight boron carbide. The process of the Lowe Patent consists basically of a blending of boron carbide and up to 15% by weight of aluminum powder; hot-pressing at 1800°–1900° C under pressure of at least 500 psi to give a relatively low density piece; fragmentizing this hot-pressed piece and pulverizing the fragments in the presence of water to a particle size of approximately 15 microns for the purpose of eliminating aluminum carbide formed during the hot-pressing cycle; followed by hot-pressing of the so prepared powdered mixture of boron carbide, which now contains 2–5% aluminum, at a temperature of 1850°–2325° C under a pressure of not less than 1500 psi to produce a high-density boron carbide-aluminum product. Although this process produces highly useful products, it is a costly process in that it involves two high temperature hot-pressing steps and the necessary step of crushing and milling the product resulting from the initial hot-pressing step.

SUMMARY OF THE INVENTION

Briefly, the invention is a lower cost method of fabricating high-density, high-strength boron carbide-aluminum composite artifacts or products. In the invention process, boron carbide that is less than 100% stoichiometrically pure, that is having a molar ratio of boron to carbon less than or greater than 4:1 and preferably less than 4:1, is blended with aluminum and a temporary organic binder and placed in a conventional steel mold and preformed to the desired shape by pressing at, for example, room temperature and a pressure of approximately 2500 psi. This relatively low density preformed product is then placed in an appropriate graphite mold and pressed at a temperature of 1800° to 2300° C under a pressure of at least 500 psi, and preferably between 500 and 1000 psi which facilitates the final densification of the shaped product, the density ranging between a minimum of 2.50 to the theoretical maximum density of 2.54 grams per cubic centimeter.

From the foregoing discussion of the prior art and the brief description of the process of the present invention, the economic advantage of the latter becomes apparent. The invention process eliminating the very high pressure required in the process of the prior art to make use of somewhat the same pressure in a less costly cold-pressing operation, and further eliminates the need for the prior art step of crushing and pulverizing the previously hot pressed low density boron carbide-aluminum composition, and the subsequent requirement of milling this product with water, in order to hydrolyze and remove the aluminum carbide formed. Unlike the prior art process described above, the present process results in no significant amount of aluminum carbide formation within the $B_4C$ body. Why no aluminum carbide of significance appears in the final product of the present invention, particularly in view of the prior art, is not completely understood. The great difficulty of quantitatively and qualitatively analyzing such a product as that produced by the invention process, is well appreciated by one skilled in the art. Nevertheless, attempts were made to analyze the final product. The results of the attempted analysis were far from conclusive. Boron, carbon and aluminum were positively identified, these constituents being present in relatively large amounts, however, minor quantities of other materials were also obviously present but defied positive identification. There appeared to be some small quantity of an aluminum borocarbide and an aluminum-boron compound, and a minor quantity of some unidentifiable third compound.

DESCRIPTION OF THE PREFERRED EMBODIMENT

The invention process may be carried out with commercially available boron carbide and aluminum powders. The particle size of these materials is not hypercritical, however, coarser particle sized materials make the production of products having theoretical density more difficult. The desired particle size of the boron carbide is between 3–15 microns and that of the aluminum powder need not be ideally stoichiometric i.e. the boron to carbon molar ratio need not be 4.0; a material with a B:C molar ratio of from 3.5 to 4.5:1 results in an excellent product.

The boron carbide and aluminum powders are blended together in proportions of 3–30% by weight of aluminum and 70–97% by weight of boron carbide using any commercially available blending equipment such as a V-shaped twin-shell blender, vertical spindle mixer, ball mill, or the like. After preparing the desired blend of boron carbide and aluminum, it is then dampened or wetted with a temporary organic binder in a quantity sufficient to give the green preformed product resulting from the subsequent cold-pressing step of the process, adequate strength to be handled; this is preferably a quantity sufficient to wet all the particles. The use of organic temporary binders for this purpose is well known in the art and any of these well known materials may be utilized here e.g. emulsifiable waxes and polyethylene, dextrine, phenoformaldehyde condensation polymers, or the like disolved or emulsified in a vehicle such as water, alcohol, acetone etc., the vehicle depending on the temporary organic binder selected. Experience has taught that a 50 - 50% by weight of organic solid in the vehicle provides a liquid which very effectively and easily wets the boron carbide-aluminum blend. The amount of organic material that is emulsifiable or soluable in a vehicle will, of course, depend on the choice of either or both.

Once the boron carbide-aluminum blend has been wetted with the organic binder liquid, the vehicle is then volatilized, preferably with heat. The temperature at which said vehicle is evaporated or volatilized is not critical except in that the temperature should not exceed the decomposition temperature of the organic materials employed. With most temporary binders temperatures as high as 200° C may be used, however, generally speaking temperatures up to or approaching the boiling point of the vehicle are prefered. For example, if a water emulsifiable organic polymer is used as the temporary binder, the water is preferably removed at a temperature of 60°-100° C.

A predetermined weight of the boron carbide-aluminum blend wetted with temporary organic binder is charged to a standard type steel mold, the internal chamber of which defines the shape of the product to be fabricated. The mold is assembled and the contents thereof subjected to a pressure as high as that permitted by the available pressing equipment and preferably in excess of 1500 psi and up to as high a pressure as the mold will allow, usually about 2500 psi; this pressing may be accomplished at ambient temperature. The resulting preformed product is then removed from the steel mold, and because of the green strength imparted by the temporary organic binder, is easily transfered to a graphite mold having an internal chamber of the proper dimensions and configuration. The graphite mold is finally assembled and placed in a light duty hot pressing furnace, e.g. a pressing furnace designed to operate in the 500-1000 psi range. The temperature is rapidly brought up to between 1800°-2300° C and preferably to about 1950° C while simultaneously flushing an essentially $O_2$ free gas through the apparatus and incrementally applying pressure until said pressure reaches at least 500 psi. These temperature and pressure conditions are maintained until contraction of the piece within the mold ceases, at which point the density of the boron carbide-aluminum piece is between 2.5 - 2.54 grams per cc. Obviously the higher the pressure used the faster will be the compression and ultimate densification of the piece being fabricated. However, low pressures of 500-1000 psi are of a distinct advantage, in that the pressing equipment required is less complex and less costly and the wear and tear, including breakage, on the graphite mold set-up is greatly minimized. Once the desired degree of densification has been brought about, the heat source to the pressing furnace is shut off and the mold and its contents are allowed to cool at a natural rate while gradually dropping the pressure. The pressure is preferably decreased slowly. For example, if the holding pressure is 500 psi, than the pressure is advantageously decreased at the rate of 50 psi per minute. Once the product and graphite mold have cooled sufficiently to permit convenient handling of the formed product, it is removed from the mold.

Boron carbide-aluminum products formed in this manner are dense, strong and wear-resistent, and when removed from the mold are ready for those finishing steps required depending on what the fabricated product is intended for. For example, if the product is to be used as a ballistic armor tile or plate, it is then combined with the required spall shield and laminated backing composite. The following is an example of the invention process and product wherein the pieces fabricated are tiles to be used as ballistic armor.

EXAMPLE I

A ballistics armor material in the form of a tile or plate measuring approximately 11.5 × 17.5 × 0.3 inches was manufactured in the following manner:

2300 grams of $B_4C$ powder having an average particle size of 9 microns and a molar B:C ratio of 3.85:1 was blended in a twin-shell V-shaped blender with 230 grams of aluminum powder having an average particle size of less than 75 microns, and 845 grams of an approximate 40 weight percent water emulsion of Amprol 24, an emulsifiable wax manufactured by the Atlantic Refining Company (the actual weight percent composition of the wax emulsion used was 40.1 Amprol 24, 55.0 water, 3.8 stearic acid, and 1.0 isopropanolamine). The blend of materials was dried at 85° C to volatilize the 475 grams of water.

The 2900 grams of granular blend was then placed in a conventional steel mold, the cavity of which was approximately 11.5 × 17.5 inches. The mold set-up containing the blend was placed in an hydraulic press and a pressure of 2000 psi was applied at room temperature to facilitate preliminary preforming and densification of a plate approximately 11.5 × 17.5 × 0.75 inches.

The preform was then removed from the steel mold and placed in an appropriately constructed graphite mold which was then transferred to a hot pressing furnace. The graphite mold set-up and the hot pressing furnace were the same as those which are used generally to hot-press refractory materials such as alumina, silicon carbide, zirconia, boron carbide and the like, although the pressure used as described below is considerably lower than that normally used to hot-press $B_4C$ products when the desired density of said products approaches theoretical.

While flushing nitrogen gas through the furnace, the temperature of the graphite mold and contents was elevated to 1975° C over a period of 3 hours. When the temperature reached 1925° C, pressure was applied to the plunger components of the graphite mold at a rate of 56 psi per 5 minutes to a maximum pressure of 500 psi. Once the temperature had attained 1975° C is was reduced to 1950° C and held at the latter temperature until compression of the preformed plate within the graphite mold ceased, at which point the heat input was terminated, and the pressure maintained constant for about 5 additional minutes. The pressure was then diminished to atmospheric pressure at the rate of 56 psi every 5 minutes. The final product was hard, strong and dense having a specific gravity of 2.52 g./cc. Several tiles were made in this manner.

From the essentially boron carbide-aluminum plates, so fabricated, were cut 6 × 6 × 0.3 inch plates which were joined with a glass cloth-resin laminate backing, which makes up no part of the instant invention. The completed 6 × 6 inch composites had an overall weight of 6.20 pounds per square foot. They were tested ballistically against boron carbide plates made with identical cloth-resin laminate backing, this composite weighing 6.55 pounds per square foot. The boron carbide-aluminum armor was superior to its straight boron carbide counterpart in that the former was as equally effective in resisting the penetration of armor piercing 0.30 caliber projectiles traveling, at a given velocity at the point of impact despite the fact that the boron-carbide-aluminum armor had the important advantage of being lighter in weight for a given unit area than was the boron carbide armor.

The foregoing example is only intended to be illustrative. Other applications of the boron carbide-aluminum reaction product resulting from the process of the instant invention, may become apparent to those skilled in the art who may have a need for a high strength, wear resistant refractory material produced by a relatively inexpensive and simple process.

What is claimed is:

1. A process of forming boron carbide-aluminum reaction products comprising:
   - uniformly blending 70–97% by weight of powdered boron carbide with 3–30% by weight of powdered metallic aluminum;
   - wetting the blended boron carbide-aluminum mixture with temporary organic binder contained in a vehicle;
   - volatilizing the vehicle for said temporary organic binder;
   - preforming and densifying said boron carbide-aluminum-organic binder mixture with pressure at a temperature below 200° C;
   - hot-pressing said preform at a pressure of at least 500 psi at a temperature of from 1800° to 2300° C in an atmosphere substantially free of oxygen.

2. The process of claim 1 wherein the average particle size of said powdered aluminum is less than 75 microns, and the average particle size of said powdered boron carbide is between 3 and 15 microns with a boron to carbon molar ratio equal to 3.5 to 4.5:1.

3. The process of claim 2 wherein said vehicle carried temporary organic binder is added to said blend of boron carbide and aluminum such that the amount of said organic binder on a weight basis is between 5 and 20% of said boron-carbide-aluminum-organic binder mixture and said preforming and densifying step is performed at up to 100° C and a pressure of at least 500 psi.

4. The process of claim 1 wherein said blend of boron carbide and aluminum consists essentially of 5–15% by weight of aluminum and 85–95% by weight of boron carbide having a boron to carbon molar ratio equal to 3.8 to 4.0, said vehicle carried temporary organic binder contains 40–60% by weight of solid temporary binder said vehicle being evaporated at 60°–100° C, said preforming and densifying step is performed at ambient temperature and a pressure of 1500–2500 psi, and said hot-pressing step is carried out at 1900°–2000° C under a pressure of 500–1000 psi.

5. An article of manufacture resulting from subjecting blends of boron carbide powder and aluminum metal powder to the process of claim 1.

6. An article of manufacture resulting from subjecting mixtures of boron carbide powder and aluminum powder to the process of claim 2.

7. An article of manufacture resulting from subjecting mixtures of boron carbide powder and aluminum powder to the process of claim 3.

8. A ballistics armor material resulting from subjecting mixtures of boron carbide powder and aluminum powder to the process of claim 4.

* * * * *